US005162182A

United States Patent [19]

Maruta

[11] Patent Number: 5,162,182

[45] Date of Patent: Nov. 10, 1992

[54] PHOTOSENSITIVE MEMBER FOR ELECTROPHOTOGRAPHY WITH INTERFERENCE CONTROL LAYER

[75] Inventor: Yukihiro Maruta, Kawasaki, Japan

[73] Assignee: Fuji Electric Co., Ltd., Kawasaki, Japan

[21] Appl. No.: 782,440

[22] Filed: Oct. 28, 1991

[30] Foreign Application Priority Data

Nov. 1, 1990 [JP] Japan ..... 2-296592

[51] Int. Cl.[5] ..... G03G 5/14; G03G 5/047

[52] U.S. Cl. ..... 430/58; 430/66; 430/67

[58] Field of Search ..... 430/58, 66, 67

[56] References Cited

U.S. PATENT DOCUMENTS 3,655,377 4/1972 Sechack ..... 430/57
4,617,245 10/1986 Tanaka et al. ..... 430/58
4,766,048 8/1988 Hisamura ..... 430/67 X
4,833,055 5/1989 Kazama et al. ..... 430/66
4,880,717 11/1989 Kitagawa et al. ..... 430/67 X
4,891,290 1/1990 Narita ..... 430/67 X

FOREIGN PATENT DOCUMENTS 242231 10/1987 European Pat. Off. ..... 430/66

*Primary Examiner*—Roland Martin
*Attorney, Agent, or Firm*—Spencer, Frank & Schneider

[57] ABSTRACT

A photosensitive member for electrophotography has a conductive substrate provided thereon with, in order, a charge transport layer, a charge generation layer, an interference control layer and an overcoating layer. The interference control layer has a refractive index substantially equal to the geometrical mean of the refractive indexes of the charge generation layer and the overcoating layer and a thickness such that the optical phase difference is substantially equal to $\pi/2$ radian or $3\pi/2$ radian.

15 Claims, 5 Drawing Sheets

PHOTOSENSITIVE MEMBER FOR ELECTROPHOTOGRAPHY WITH INTERFERENCE CONTROL LAYER

BACKGROUND OF THE INVENTION

1. Field of the Invention

The present invention relates to a photosensitive member for electrophotography used in electrophotographic devices such as copying apparatuses, printers and facsimiles in which a coherent light such as laser light is used for exposure.

2. Description of the Prior Art

The photosensitive members for electrophotography must have high sensitivity, long life and high heat resistance and provide images of high quality over a long time. Recently, there have been put to practical use electrophotographic devices such as copying apparatuses, printers and facsimiles in which images are formed by optically scanning a photosensitive member with a laser light modulated depending on digital image information to expose the photosensitive member. In these electrophotographic devices, small-sized semiconductor lasers have widely been employed as laser light sources. The photosensitive members used in such apparatuses must be highly sensitive to semiconductor laser beam whose wavelength ranges from 750 to 800 nm.

As such photosensitive members for electrophotography, there have been known separated-function photosensitive members in which selenium-containing materials are used as photoconductive materials and which comprise a substrate provided thereon 3 to 4 laminated photosensitive layers. The separated-function photosensitive members are detailed in, for instance, U.S. Pat. No. 3,655,377 and Japanese Patent Application Laying-Open Nos. 4240/1977 and 77744/1980. The photosensitive members basically have a structure which comprises, as shown in FIG. 1, a conductive substrate 1 provided thereon with in order a charge transport layer (CTL) 2, a charge generation layer (CGL) 3 and an overcoating layer (OCL) 4.

The separated-function photosensitive member provided with such laminated photosensitive layers does not provide high quality images since a laser light used for exposing the member causes multiple reflection in the photosensitive layer thereof and as a result, and interference pattern is formed on the resulting images, in particular half-tone dot images.

FIG. 2 is a schematic diagram for illustrating the multiple reflection observed when a conventional separated-function photosensitive member which is commonly utilized and has a structure shown in FIG. 1 is irradiated with a laser light. FIG. 2 illustrates the multiple reflection which is generated by a laser light diagonally incident upon the surface of the conventional separated-function photosensitive member in order to explain obviously a reflection at an interface between CGL 3 and OCL 4. A part of a laser light 6 incident upon the surface of the photosensitive member is reflected at the interface between the air and OCL 4 due to the difference between the refractive indexes thereof, while the remaining laser light I, pass through OCL 4 and is made incident upon CGL 3. At this stage, a part of the laser I, is likewise reflected at the interface between CGL 3 and OCL 4 because of the difference between the refractive indexes thereof, but a reflected light is partially reflected at the interface between the air and OCL 4 to form a reflected light light $R_1$ which passes through OCL 4 and partially reflected at the interface between CGL 3 and OCL 4 and the remaining light light is made incident upon CGL 3. A part of the light $R_1$ reflected at the interface between CGL 3 and OCL 4 is further partially reflected at the interface between the air and OCL 4 to form a reflected light light $R_2$ which, like the light $R_1$, passes through OCL 4 and partially reflected at the interface between CGL 3 and OCL 4 and the remaining light is made incident upon CGL 3. As has been discussed above, the incident light reflected at the interface between CGL 3 and OCL 4 undergo multiple reflection within OCL 4 and are made incident upon CGL 3 and the light 8 incident upon CGL 3 are interference lights of $I_1$, $R_1$, $R_2$ . . . . Thus, the intensity of the laser lights vertically incident upon CGL 3 varies dependent upon the thickness of OCL 4 and if the refractive index of OCL 4, the deviation in the film thickness thereof and the wavelength of the laser light is defined to be $n_1$, d and $\lambda$, respectively, the number (m) of the interference fringes generated is equal to $2n_1d/\lambda$.

The laser light vertically incident upon the photosensitive layer undergoes multiple reflection within the overcoating layer (OCL) 4 and the reflected light causes interference because of the coherency of the laser light. In this case, if OCL 4 has a deviation in film thickness, the reflected light is intensified or weakened due to the interference and correspondingly the number of charges generated within a charge generation (CGL) 3 is increased or decreased. As a result, such an interference pattern is formed. Further, the laser light which is not absorbed by CGL 3 and transmitted therethrough reaches the surface of conductive substrate 1, causes regular reflection and the reflected light causes multiple reflection within CTL 2 to thus cause interference. In this case, if CTL 2 has a deviation in film thickness, the reflected light is intensified or weakened due to the interference as has explained above in connection with OCL 4 and this likewise becomes a cause of the appearance of the interference pattern. The interference patterns due to these phenomena which are superimposed to one another often appear on the resulting image.

There have been known methods for eliminating the latter interference pattern resulting from the light which transmits through CGL and is reflected by the surface of the substrate by treating the surface of the substrate. These methods are detailed in, for instance, Japanese Patent Application Laying-Open Nos. 225854/1985, 254168/1985 and 167761/1989. However, there has not yet been developed any means for eliminating the former interference pattern resulting from the light directly incident upon CGL.

As has been described above, the selenium type separated-function photosensitive member has a basic structure as shown in FIG. 1. In the case of photosensitive member having such a structure, the laser light directly incident upon the member greatly contribute to the generation of charges as compared with the contribution by the laser light which transmits through CGL and is reflected by the surface of the substrate. For this reason, the interference pattern resulting from the interference due to the multiple reflection, within OCL, of the laser light incident upon the photosensitive member would be formed easier than that resulting from the interference due to the multiple reflection, within CTL, of the laser light reflected by the substrate surface. Under such circumstances, the inventors of this invention have supposed that it is necessarily more important and effective to eliminate the effect of the former interference than to eliminate the influence of the latter interference, in order to solve the problem of the formation of interference patterns.

SUMMARY OF THE INVENTION

Accordingly, the object of the present invention is to provide a photosensitive member for electrophotography which comprises a conductive substrate provided thereon with, in order, at least a CTL, a CGL and an OCL and which can suppress the formation of any interference pattern, on the resulting images, resulting from the interference due to the multiple reflection within the OCL even when coherent light such as laser light is used for exposing the photosensitive member.

The aforementioned object of the present invention can effectively be achieved by providing a photosensitive member for electrophotography which comprises a conductive substrate and a photosensitive layer formed on the conductive substrate, the photosensitive layer comprising a charge generation layer capable of generating charges through irradiation with light, a charge transport layer which is arranged between the charge generation layer and the conductive substrate and which can transport the charges generated in the charge generation layer to the conductive substrate, and overcoating layer for protecting the charge transport layer and the charge generation layer and an interference control layer arranged between the overcoating layer and the charge generation layer, the interference control layer having a refractive index substantially equal to the geometrical mean of the refractive indexes of the charge generation layer and the overcoating layer and a film thickness such that the optical phase difference is substantially equal to $(\pi/2+n\pi)$ radian (n=0 or 1).

The charge transport layer may be formed from a material selected from the group consisting of pure Se and Se alloys.

The charge generation layer may be formed from an Se-Te alloy wherein the Se-Te alloy may, in turn, be a high Te content Se-Te alloy such as those having a Te concentration of about 43% by weight.

The overcoating layer may comprise an Se alloy wherein the Se alloy may be an Se-Te alloy. Moreover, the Se-Te alloy may be a low Te content Se-Te alloy such as those having a Te concentration of about 5% by weight. In addition, the Se alloy constituting the overcoating layer may be an Se-As alloy. The Se-As alloy may be a low As content Se-As alloy such as those having an As concentrating 5% by weight.

The interference control layer may be formed from an Se-Te alloy wherein the Se-Te alloy may be an Se-Te alloy having a Te concentration of not less than about 20% by weight and not more than about 28% by wight. The thickness of the interference control layer may be not less than 0.04 μm and not more than 0.09 μm or not less than 0.17 μm and not more than 0.22 μm.

When a semiconductor laser (wavelength: 780 nm) is used as a light source for exposure, it is effective to use a photosensitive member in which the charge transport layer is formed from pure selenium or an Se alloy, the charge generation layer is formed from an Se-Te alloy, the overcoating layer is formed from an Se alloy and the interference control layer is formed from an Se-Te alloy.

In a specific embodiment, the charge generation layer is formed from a high Te content Se-Te alloy having a Te concentration of about 43% by weight, the overcoating layer is formed from either a low Te content Se-Te alloy having a Te concentration of about 5% by weight or a low As content Se-As alloy having an As concentration of about 5% by weight, the interference control layer is formed from an Se-Te alloy having a Te concentration of not less than about 20% weight and not more than about 28% by weight and the film thickness of the interference control layer is adjusted to not less than 0.04 μm and not more than 0.09 μm and not more than 0.22 μm.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will hereinafter be explained in more detail with reference to the accompanying drawings.

Figure 1:
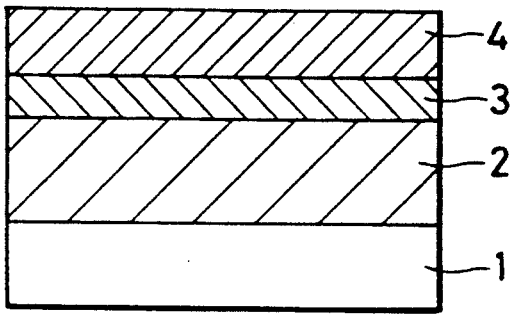
FIG. 1 (PRIOR ART)
FIG. 1 is a schematic cross sectional view showing a conventional photosensitive member.
Figure 2:
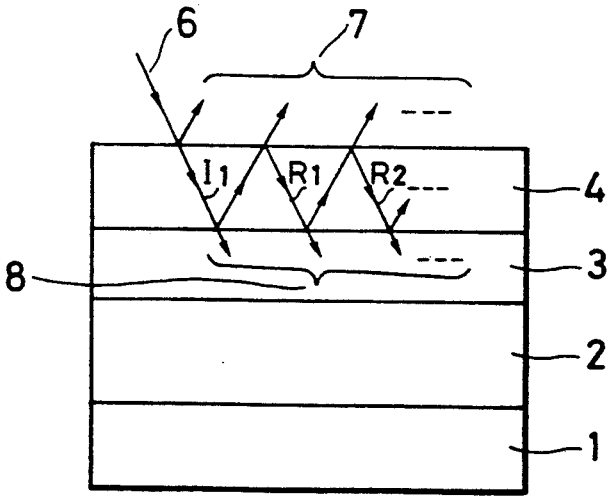
FIG. 2 (PRIOR ART)
FIG. 2 is a schematic diagram illustrating the multiple reflection observed when coherent light is made incident upon the photosensitive member shown in FIG. 1.
Figure 4:
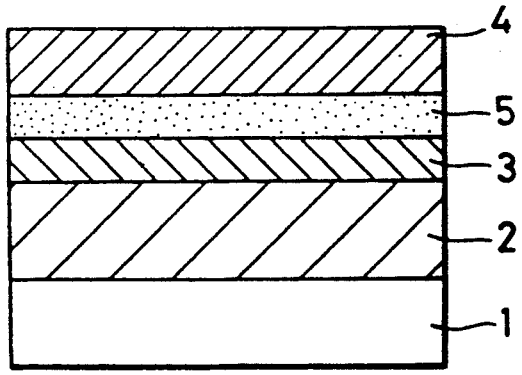
FIG. 4 is a schematic cross sectional view showing an embodiment of a photosensitive member according to the present invention.

FIG. 4 is a schematic cross sectional view showing an embodiment of the photosensitive member according to the present invention. In FIG. 4, components identical or similar to those of the conventional photosensitive member shown in FIG. 1 are represented by the same corresponding numerical values, respectively.

In the photosensitive member according to the present invention, an interference control layer (ICL) 5 is arranged between OCL 4 and CGL 3 as shown in FIG. 4. When the photosensitive member having such a structure is irradiated with a laser light, there is observed multiple reflection in OCL 4 and ICL 5 such as that shown in FIG. 5 wherein the laser lights $R_{11}$, $R_{12}$. . . generated due to the multiple reflection within OCL 4 can be almost cancelled by the laser lights $R_{21}$, $R_{22}$. .

Figure 5:
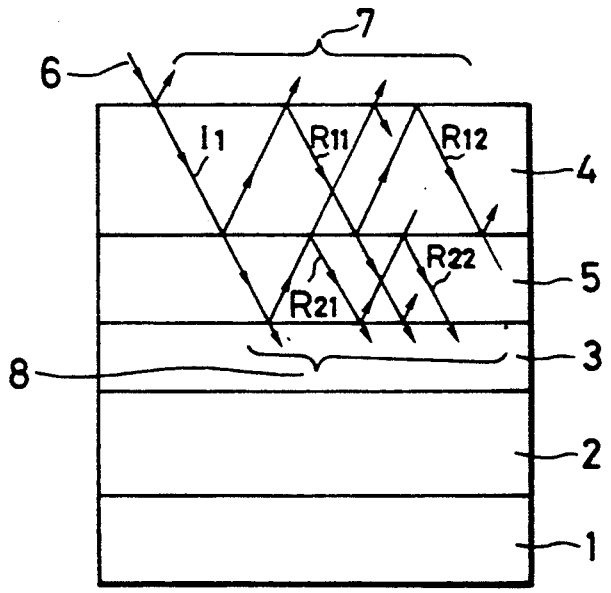
FIG. 5 is a schematic diagram illustrating a multiple reflection observed when coherent light is made incident upon the photosensitive member shown in FIG. 4.

. generated due to the multiple reflection within ICL 5. FIG. 5 illustrates the multiple reflection which is generated by a laser light diagonally incident upon the surface of the photosensitive member according to the present invention in order to explain obviously reflection at interfaces between OGL 4 and ICL 5, and between CGL 3 and ICL 5. As a result, the intensity of the laser light vertically incident upon CGL 3 becomes uniform and thus the formation of any interference pattern can effectively be eliminated, if the refractive index and thickness of ICL 5 are properly selected as will be explained below in detail.

The principle of the refractive index and thickness of ICL 5 will be theoretically discussed below. The intensifying and weakening of laser lights transmitted to CGL 3 due to the interference correspond to the intensifying and weakening of the surface amplitude reflectance of the photosensitive member. Thus, in order to make the laser light incident upon CGL 3 uniform, the light lights 7 reflected on the surface of the photosensitive member must be made uniform.

On the other hand, a surface amplitude reflectance R of a conventional photosensitive member shown in FIG. 1 is given by the following equation (1):

$$R=\gamma_1+\gamma_2\cdot exp(-2i\delta_1)-\gamma_1\cdot\gamma_2^2\cdot exp(-4i\delta_1)+\gamma_1^2\cdot\gamma_2^3\cdot exp(-6i\delta_1) \quad (1)$$

where $\gamma_1$ and $\gamma_2$ represent a Fresnel reflectance at the interface between OCL 4 and the air and a Fresnel reflectance at the interface between OCL 4 and CGL 3 respectively and are given by the following equations (2-1) and (2-2) if the refractive indexes of the air, OCL 4 and CGL 3 are defined to be $n_0$, $n_1$ and $n_2$, respectively:

$$\gamma_1=(n_1-n_0)/(n_1+n_0) \quad (2\text{-}1)$$

$$\gamma_2=(n_2-n_1)/(n_2+n_1) \quad (2\text{-}2)$$

Further, $\delta_1$ means an optical phase difference and is given by the following equation (3) if the wavelength of the laser light and the thickness of OCL 4 are defined to be $\lambda$ and d respectively:

$$\delta_1=2\pi\cdot n_1\cdot d/\lambda \quad (3)$$

In the equation (1), the third and higher terms can be neglected.

Figure 3:
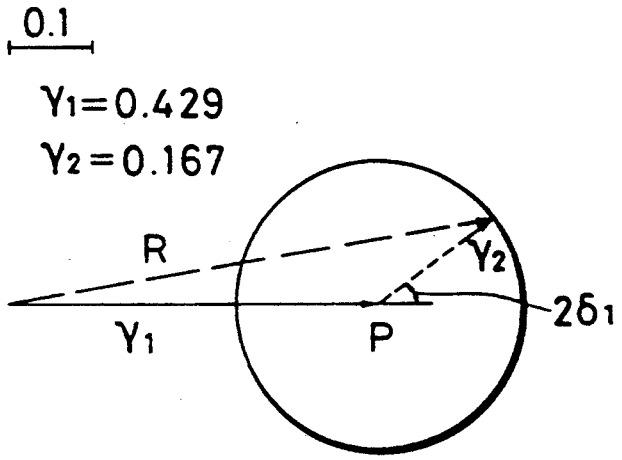
FIG. 3 (PRIOR ART)
FIG. 3 is a vector diagram illustrating Fresnel surface amplitude reflectance of the photosensitive member shown in FIG. 1.

The foregoing can be expressed by a vector diagram which is illustrated in FIG. 3. FIG. 3 shows an example in which the refractive indexes $n_0$, $n_1$ and $n_2$ and the wavelength of the laser light $\lambda$ are 1, 2.5, 3.5 and 0.78 $\mu$m respectively. In this case, $\gamma_1$ and $\gamma_2$ can be calculated to be 0.429 and 0.167 according to equation (2) and the trajectory of the surface amplitude reflectance R becomes a circle as shown in FIG. 3 when there is a deviation in film thickness such that the optical phase difference is $2\pi$ (radian) or higher. The maximum and minimum of R in FIG. 3 correspond to the magnitudes thereof observed when it is intensified or weakened due to the interference. If they are defined to be $R_{max}$ and $R_{min}$ respectively, the difference therebetween, $R_{max}-R_{min}$ is calculated to be 0.334.

The photosensitive member provided with ICL 5 as shown in FIG. 4 will now be explained. In this case, the surface amplitude reflectance R of the photosensitive member is given by the following equation (4):

$$R=\gamma_1+\gamma_2\cdot exp(-2i\delta_1)-\gamma_3\cdot exp[-2i(\delta_1+\delta_2)] \quad (4)$$

wherein $\gamma_1$, $\gamma_2$ and $\gamma_3$ represent Fresnel reflectance observed at the interface between the air and OCL 4, at the interface between OCL 4 and ICL 5 and at the interface between ICL 5 and CGL 3 respectively and are given by the following equations (5-1), (5-2) and (5-3) if the refractive indexes of the air, OCL 4, ICL 5 and CGL 3 are defined to be $n_0$, $n_1$, $n_2$ and $n_3$, respectively:

$$\gamma_1=(n_1-n_0)/(n_1+n_0) \quad (5\text{-}1)$$

$$\gamma_2=(n_2-n_1)/(n_2+n_1) \quad (5\text{-}2)$$

$$\gamma_3=(n_3-n_2)/(n_3+n_2) \quad (5\text{-}3)$$

Further, $\delta_1$ and $\delta_2$ mean optical phase differences and are given by the following equations (6-1) and (6-2) if the wavelength of the laser light and film thicknesses of OCL 4 and ICL 5 are defined to be $\lambda$, $d_1$ and $d_2$, respectively:

$$\delta_1=2\pi\cdot n_1\cdot d_1/\lambda \quad (6\text{-}1)$$

$$\delta_2=2\pi\cdot n_2\cdot d_2/\lambda \quad (6\text{-}2)$$

In equation (4), the fourth and higher terms can be neglected.

Figure 6:
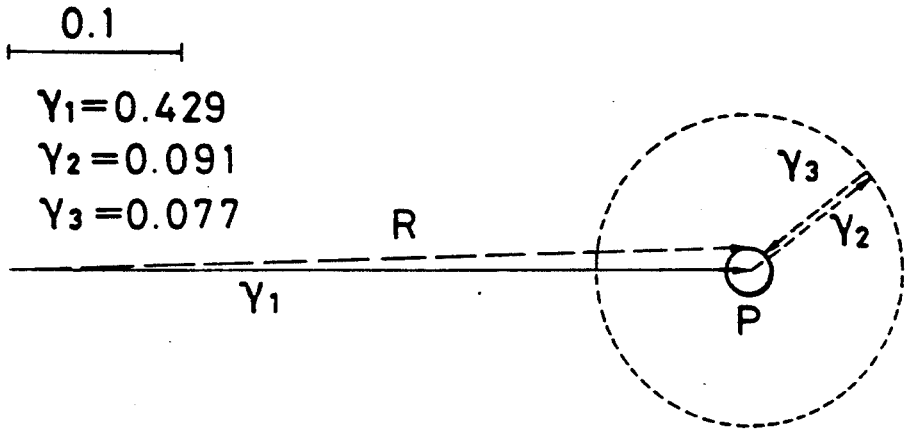
FIG. 6 is a vector diagram illustrating Fresnel surface amplitude reflectance of the photosensitive member shown in FIG. 4 observed when an optical phase difference of the film thickness of an interference control layer is substantially equal to $\pi/2$ (radian)

The foregoing can be expressed by a vector diagram which is illustrated in FIG. 6. In the embodiment illustrated in FIG. 6, the refractive indexes $n_0$, $n_1$, $n_2$ and $n_3$ and the wavelength of the laser light $\lambda$ are assumed to be 1, 2.5, 3.0, 3.5 and 0.78 $\mu$m respectively. Further, OCL 4 and ICL 5 have, respectively, film thickness deviations such that the optical phase difference $\delta_2$ is $\pi/2$ (radian).

In this case, the vectors $\gamma_2$ and $\gamma_3$ form an angle of $2\delta_2$, i.e., $\pi$ (radian) and the directions of these vectors are opposite to one another. Moreover, the refractive index $n_2$ of ICL 5 of the order of 3.0 substantially satisfies the antireflection requirement: $n_2^2=n_1\cdot n_3$ with respect to OCL 4 (refractive index $n_1=2.5$) and CGL 3 (refractive index $n_3=3.5$). In this case, $\gamma_1$, $\gamma_2$ and $\gamma_3$ can be calculated to be 0.429, 0.091 and 0.077, respectively, according to equation (5), thus $\gamma_2$ is substantially cancelled by $\gamma_3$ as shown in FIG. 6 and the trajectory of the surface amplitude reflectance R becomes a circle quite smaller than that shown in FIG. 3. The difference, $R_{max}-R_{min}$ is very small in the order of 0.028. This means that the intensifying and weakening thereof due to the interference is greatly reduced as compared with the photosensitive member free of ICL 5.

Figure 7:
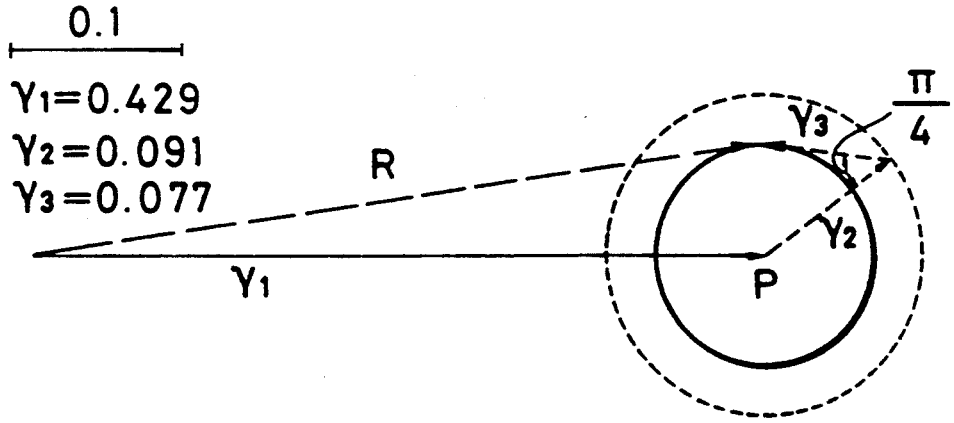
FIG. 7 is a vector diagram illustrating Fresnel surface amplitude reflectance of the photosensitive member shown in FIG. 4 observed when the optical phase difference of the film thickness of the interference control layer is substantially equal to $\pi/2$ (radian) and the optical deviation in the film thickness thereof is $\pm\pi/8$.

In practice, ICL 5 also has a deviation in film thickness. If the deviation in film thickness of ICL 5 is $\pm\pi/8$ (radian) expressed in terms of optical phase difference, the direction of $\gamma_1$ is not completely opposite to that of $\gamma_3$ and they form an angle of $\pi/4$ (radian). This can be expressed by a vector diagram as shown in FIG. 7. In this case, the difference, $R_{max}-R_{min}$ is 0.13 which is equal to a little less than 40% of that for the material free of ICL 5.

The thickness $d_2$ of ICL 5 is given by the following equation (7):

$$d_2=\delta_2\cdot\lambda/(2\pi\cdot n_2) \quad (7)$$

As has been described above, to make the directions of $\gamma_2$ and $\gamma_3$ opposite to one another, the optical phase difference $\delta_2$ must be $\pi/2$ (radian), $3\pi/2$ (radian), $5\pi/2$ (radian), . . . and in each case, the thickness of ICL 5 is 650 Å, 1950 Å, 3250 Å . . . , respectively. In this case, the thickness of $d_2$ of ICL 5 is calculated while assuming that each layer has a deviation in film thickness of $\pm\pi/8$ (radian) expressed in terms of optical phase difference. The results obtained are summarized in the following Table 1.

TABLE 1

| (radian) | (Å) | Deviation in Film Thickness (%) |
|---|---|---|
| $\pi/2 \pm \pi/8$ | 478~813 | 50 |
| $3\pi/2 \pm \pi/8$ | 1718~2113 | 17 |
| $5\pi/2 \pm \pi/8$ | 3087~3413 | 9 |
| $7\pi/2 \pm \pi/8$ | 4387~4713 | 7 |

As seen from the data listed in Table 1, if $\delta_2$ exceeds $5\pi/2\pm\pi/8$, ICL must be designed so that the deviation in film thickness becomes 9% or smaller, but this is very difficult from the technical standpoints. For this reason, $d_2$ is suitably not less than 400 Å and not more than 900 Å or not less than 1700 Å and not more than 2200 Å from the viewpoint of practical application.

As has been explained above, in a photosensitive member having a conductive substrate provided thereon with, in order, a CTL, a CGL and an OCL, the formation of an interference pattern on the resulting images due to the multiple reflection, within OCL, of a coherent light such as a laser light can be eliminated by arranging, between OCL (refractive index$=n_1$) and CGL (refractive index$=n_3$), and ICL which has a refractive index substantially equal to the geometrical mean of $n_1$ and $n_3$ and satisfying the antireflection requirement ($n_2^2=n_1 \cdot n_3$) and which has a thickness such that the optical phase difference is around $\pi/2$ (radian) or $3\pi/2$ (radian) even if OCL has a deviation in film thickness equal to $2\pi$ radian expressed in terms of optical phase difference.

When a semiconductor laser (wavelength 780 nm) is used as a source of the coherent light, the photosensitive member preferably has a CTL of pure Se or an Se alloy, an OCL of an Se alloy and an ICL of an Se-Te alloy. Thus, the resulting photosensitive member has high sensitivity, a good electrification ability and long service life and can provide images of high quality over a long time.

In a specific embodiment, CGL is formed from a high Te content Se-Te alloy having a Te concentration of about 43% by weight (having a refractive index of about 3.5), OCL is formed from either a low Te content Se-Te alloy having a Te concentration of about 5% by weight or a low As content Se-As alloy having an As concentration of about 5% by weight (each having a refractive index of about 2.5), ICL is formed from an Se-Te alloy having a Te concentration of not less than about 20% by weight and not more than about 28% by weight (having a refractive index of about 3.0) and the film thickness of ICL is adjusted to not less than 0.04 μm and not more than 0.09 μm or not less than 0.17 μm and not more than 0.22 μm. If the film thickness of ICL falls within the range defined above, the absorption of light by ICL per se would be negligible because the layer is very thin.

Embodiments of the present invention will hereinafter be described.

COMPARATIVE EXAMPLE 1

As shown in FIG. 1, a photosensitive member was fabricated by vacuum-depositing a CTL 2 of pure selenium on a cylindrical aluminum substrate 1 in a thickness of 60 μm, subsequently vacuum-depositing an intermediate layer of a Se-Te alloy having a gentle concentration gradient of Te ranging from 5 to 22.5% by weight on CTL 2 in a thickness of 2 μm, then vacuum-depositing an Se-Te alloy having a Te content of 43% by weight (refractive index 3.5) on the intermediate layer in a thickness of 0.3 μm to form a CGL 3 and vacuum-deposited an Se-Te alloy having a Te content of 5% by weight (refractive index 2.5) on CGL 3 in a thickness such that the average thickness thereof was 3 μm and a deviation in thickness was equal to 0.5 μm, in other words, the thickness thereof scattered within the range of from 2.5 to 3.5 μm.

The photosensitive member thus fabricated had excellent quality, for instance, it showed only slight variation in the sensitivity and charging observed after subjecting the member to repeated 500 of charge cycles where each cycle includes charging and erasing the charge with light and had a low residual voltage. However, when the photosensitive member was fitted to a printer in which a semiconductor laser was used as a light source for exposure and half-tone toner images were printed out, an interference pattern corresponding to the deviation in thickness of OCL 4 was clearly formed on the entire image.

EMBODIMENT 1

In the same manner used in Comparative Example 1, a CTL 2 and a CGL 3 were formed on a cylindrical aluminum substrate 1, then an Se-Te alloy having a Te content of 22.5% by weight (refractive index 3.0) was vacuum-deposited onto CGL 3 in a thickness of 0.06 μm to form an ICL 5 and an OCL 4 was applied onto ICL 5 through vacuum deposition in the same manner used in Comparative Example 1 to thus give a photosensitive member having a structure as shown in FIG. 4.

The photosensitive member thus obtained had excellent electrophotographic properties. Moreover, when the photosensitive member was fitted to a printer in which a semiconductor laser was used as a light source for exposure and half-tone toner images were printed out, clear images having high quality were obtained and any interference pattern due to the deviation in thickness of OCL 4 was not formed on the images at all. Further, ICL 5 of the photosensitive member served to prevent the thermal diffusion of Te from CGL 3 to OCL 4 and as a result, it showed substantially reduced variation in the sensitivity observed after it was subjected to repeated 500 of charge cycles where each cycle includes charging and erasing the charge with light.

EMBODIMENT 2

A photosensitive member was fabricated in the same manner used in Embodiment 1 except that the thickness of ICL 5 was changed from 0.06 μm to 0.19 μm.

The resulting photosensitive member showed excellent properties almost comparable to those for the photosensitive member obtained in Embodiment 1.

COMPARATIVE EXAMPLE 2

A photosensitive member was fabricated in the same manner used in Embodiment 1 except that the thickness of ICL 5 was changed from 0.06 μm to 0.13 μm.

The resulting photosensitive member showed excellent electrophotographic almost comparable to those for the photosensitive member obtained in Embodiment 1, but when the photosensitive member was fitted to a printer in which a semiconductor laser was used as a light source for exposure and half-tone toner images were printed out, an interference pattern corresponding to the deviation in thickness of OCL 4 was clearly formed on the entire image. Further, ICL 5 of the photosensitive member served to prevent the thermal diffusion of Te from CGL 3 to OCL 4 and as a result, it showed substantially reduced variation in the sensitivity reduced variation in the sensitivity observed after it was subjected to repeated 500 of charge cycles where each cycle includes charging and erasing the charge with light, like the photosensitive member obtained in Embodiment 1.

EMBODIMENT 3

A photosensitive member was fabricated in the same manner used in Embodiment 1 except that the thickness of ICL 5 was changed from 0.06 μm to that having a scatter within the range of from 0.05 to 0.08 μm (deviation in thickness of 50%).

The resulting photosensitive member showed excellent properties almost comparable to those for the photosensitive member obtained in Embodiment 1.

EMBODIMENT 4

A photosensitive member was fabricated in the same manner used in Embodiment 1 except that the thickness of ICL 5 was changed from 0.06 μm to that having a scatter within the range of from 0.18 to 0.21 μm (deviation in thickness of 17%).

The resulting photosensitive member showed excellent properties almost comparable to those for the photosensitive member obtained in Embodiment 1.

TEST EXAMPLE 1

A photosensitive member was fabricated in the same manner used in Embodiment 1 except that the thickness of ICL 5 was changed from 0.06 μm to that having a scatter within the range of from 0 to 0.1 μm.

The resulting photosensitive member had excellent electrophotographic properties. However, when the photosensitive member was fitted to a printer in which a semiconductor laser was used as a light source for exposure and half-tone toner images were printed out, interference patterns corresponding to the deviation in thickness of OCL 4 were formed on a part of the image. The thickness of ICL 5 at the boundary between the area free of the interference pattern and that carrying interference pattern was about 0.03 μm and about 0.1 μm.

TEST EXAMPLE 2

A photosensitive member was fabricated in the same manner used in Embodiment 1 except that the thickness of ICL 5 was changed from 0.06 μm to that having a scatter within the rang of from 0.15 to 0.25 μm (deviation in thickness of 50%).

The resulting photosensitive member had excellent electrophotographic properties. However, when the photosensitive member was fitted to a printer in which a semiconductor laser was used as a light source for exposure and half-tone toner images were printer out, interference patterns corresponding to the deviation in thickness of OCL 4 were formed on a part of the image. The thickness of ICL 5 at the boundary between the area free of the interference pattern and that carrying interference pattern was about 0.16 μm and about 0.22 μm. Further, ICL 5 of the photosensitive member served to prevent the thermal diffusion of Te from CGL 3 to OCL 4, like the photosensitive member obtained in Embodiment 1.

COMPARATIVE EXAMPLE 3

A photosensitive member was fabricated in the same manner used in Embodiment 1 except that the thickness of ICL 5 was changed from 0.06 μm to 0.45 μm. When the photosensitive member was fitted to a printer in which a semiconductor laser was used as a light source for exposure and half-tone toner images were printed out, any interference pattern corresponding to the deviation in thickness of OCL 4 was not formed at all. However, the variation in properties of the photosensitive member was examined by subjecting it to repeated 500 of charge cycles where each cycle includes charging and erasing the charge with light and as a result, it was found that the electrification thereof was substantially lowered as compare with those for the photosensitive members obtained in Comparative Examples 1 and 2, Embodiments 1 to 4 and Text Examples 1 and 2.

TEST EXAMPLE 3

Four kinds of photosensitive members were fabricated in the same manner used in Embodiment 1 except that the Te concentration in ICL 5 was changed from 22.5% by weight to 14, 18, 28 and 32% by weight.

When these photosensitive members were fitted to a printer in which a semiconductor laser was used as a light source for exposure and half-tone toner images were printed out, an interference pattern corresponding to the deviation in thickness of OCL 4 was clearly formed in case of the photosensitive member provided with ICL 5 having a Te concentration of 14% by weight and was slightly formed on the members provided with ICL 5 having Te concentrations of 18 and 32% by weight respectively, while it was not formed at all on the member provided with ICL 5 having a Te concentration of 28% by weight. Further, it was observed that the photosensitive member provided with ICL 5 having a Te concentration of 32% by weight showed a great reduction of initial electrification and that the photosensitive member provided with ICL 5 having a Te concentration of 28% by weight showed a relatively great reduction of electrification observed after subjecting it to repeated 500 of charge cycles where each cycle includes charging and erasing the charge with light. Moreover, in the photosensitive members provided with ICL 5 having Te concentrations of 14, 18 and 28% by weight, ICL 5 served to prevent the thermal diffusion of Te from CGL 3 to OCL 4 and as a result, they showed substantially reduced variation in the sensitivity observed after subjecting them to repeated 500 of charge cycles as described above.

Figure 8A:
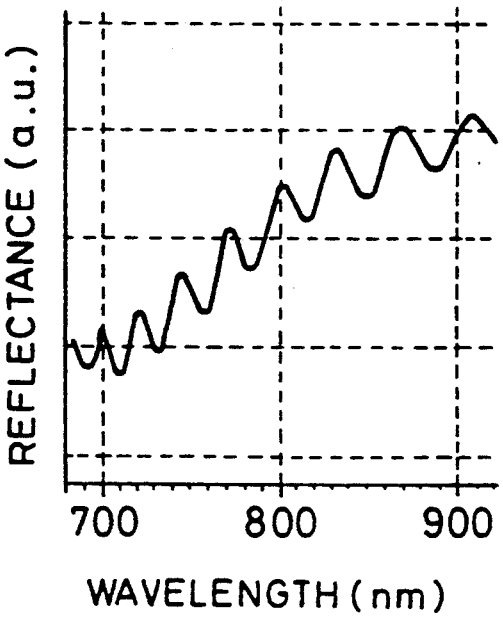
FIG. 8A to 8D are diagrammatic views each illustrating a spectral surface reflectance of the photosensitive members obtained in Embodiment 1 or 2 or Comparative Example 1 or 2.
Figure 8B:
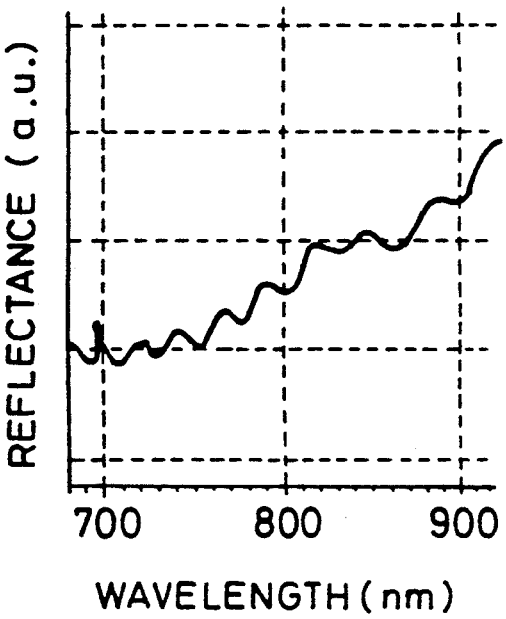
Figure 8C:
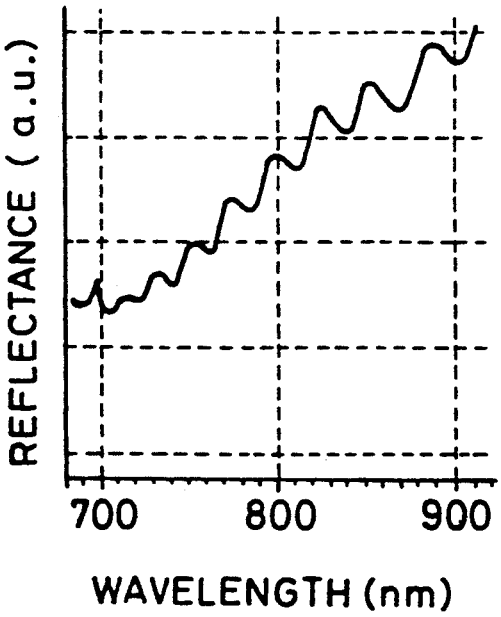
Figure 8D:
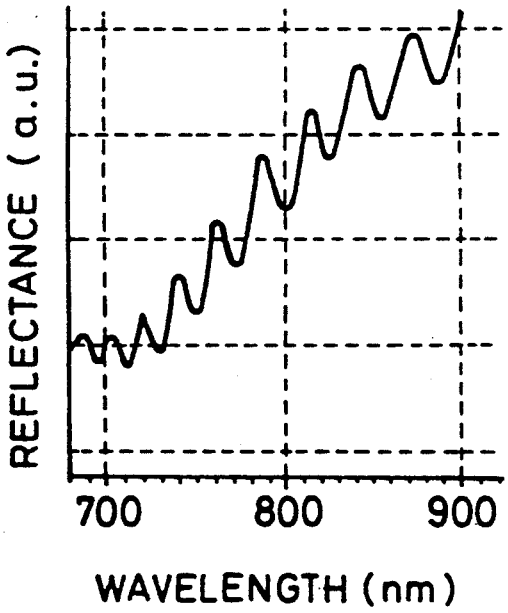

In order to further inquire into the results obtained in Embodiments, Comparative Examples and Test Examples, the photosensitive members of Comparative Examples 1 and 2 and Examples 1 and 2 were irradiated with a light having a wavelength of about 780 nm to determine surface spectral reflectance thereof. The results thus obtained are plotted in FIGS. 8A to 8D, wherein FIG. 8A is a diagram showing the results observed on the member of Comparative Example 1, FIG. 8B is a diagram showing the results observed on the members of Embodiment 1, FIG. 8C is a diagram showing the results observed on the member of Embodiment 2 and FIG. 8D is a diagram showing the results observed on the member of Comparative Example 2. As seen from these figures, the deflection of the reflectance was great in case of the photosensitive members of Comparative Examples 1 and 2 since the member of Comparative Example 1 did not have ICL or ICL of Comparative Example 2 did not have a thickness such that the intensifying and weakening of light due to the interference was cancelled and thus an interference pattern would be formed on the images. On the other hand, the deflection of the reflectance observed on the photosensitive members of Embodiments 1 and 2 was small since ICL thereof serve to reduce the intensifying and weakening due to the interference resulting from the multiple reflection within OCL and thus any interference pattern would not be formed. The foregoing results indicate that the theoretical ground for the presence of ICL is true and the theory is clearly supported by the results of Examples or the like.

In the foregoing Examples, the Se-Te alloy having a Te concentration of 5% by weight is used for preparing OCL, but the same results can be obtained if an Se-As alloy having an As concentration of 5% by weight is used since the refractive index thereof its substantially equal to that of the Se-Te alloy having a Te concentration of 5% by weight. In addition, impurities for improving electrophotographic properties may be added to Se or Se alloys for preparing each layer of the photosensitive member of the present invention and the addition thereof does not exert any influence on the effects of the present invention.

The photosensitive member according to the present invention has a conductive substrate provided thereon with, in order, at least a charge transport layer, a charge generation layer and an overcoating layer and further has, between the charge generation layer and the overcoating layer, an interference control layer which has a refractive index substantially equal to the geometrical mean of the refractive indexes of the charge generation layer and the overcoating layer and a thickness such that the optical phase difference is substantially equal to $\pi/2$ radian or $3\pi/2$ radian. The use of such an interference control layer makes it possible to obtain a photosensitive member which does not accompany the formation of any interference pattern, on the resulting images, resulting from the interference due to the multiple reflection within the overcoating layer and the deviation in film thickness, even when coherent light such as a laser light is used for exposure. The deviation in thickness of the interference control layer may be greater than that for the overcoating layer and hence the tolerance in the variation of film thickness during the formation of the interference control layer is high.

If a semiconductor laser (wavelength: 780 nm) is used as a light source for exposure, it is effective to us a photosensitive member in which the charge transport layer is formed from pre selenium or an Se alloy, the charge generation layer is formed from an Se-Te alloy, the overcoating layer is formed from an Se alloy and the interference control layer is formed from an Se-Te alloy. More specifically, preferred are the photosensitive members in which the charge generation layer is formed from a high Te content Se-Te alloy having a Te concentration of about 43% by weight, the overcoating layer is formed from either a low Te content Se-Te alloy having a Te concentration of about 5% by weight or a low As content Se-As alloy having an As concentration of about 5% by weight, the interference control layer is formed from an Se-Te alloy having a Te concentration of not less than about 20% by weight and not more than about 28% by weight and the film thickness of the interference control layer is controlled to not less than 0.04 μm and not more than 0.09 μm or not less than 0.17 μm and not more than 0.22 μm.

The photosensitive member according to the present invention having such a structure, the interference control layer also serves to prevent the thermal diffusion of Te from the charge generation layer to the overcoating layer whereby any variation in the properties of the photosensitive member can be prevented.

The invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A photosensitive member for electrophotography, comprising:
   - a conductive substrate; and
   - a photosensitive layer formed on said conductive substrate, said photosensitive layer including;
   - a charge generation layer capable of generating charges through irradiation with coherent light,
   - a charge transport layer which is arranged between said charge generation layer and said conductive substrate and which transports the charges generated in said charge generation layer to said conductive substrate,
   - an overcoating layer for protecting said charge transport layer and said charge generation layer, and
   - an interference control layer arranged between said overcoating layer and said charge generation layer, wherein said interference control layer has a refractive index substantially equal to the geometrical mean of the refractive indexes of said charge generation layer and said overcoating layer, and a film thickness such that the optical phase difference is substantially equal to $\pi/2+n\pi$ radian (n=0 or 1).

2. A photosensitive member as claimed in claim 1, wherein said charge transport layer is formed from a material selected from the group consisting of pure Se and Se alloys.

3. A photosensitive member as claimed in claim 2, wherein said charge generation layer is formed from an Se-Te alloy.

4. A photosensitive member as claimed in claim 3, wherein said Se-Te alloy is a high Te content Se-Te alloy having a Te concentration of about 43% by weight.

5. A photosensitive member as claimed in claim 1, wherein said overcoating layer is formed from an Se alloy.

6. A photosensitive member as claimed in claim 5, wherein said Se alloy is an Se-Te alloy.

7. A photosensitive member as claimed in claim 6, wherein said Se-Te alloy is a low Te content Se-Te alloy having a Te concentration of about 5% by weight.

8. A photosensitive member as claimed in claim 5, wherein said Se alloy is an Se-As alloy.

9. A photosensitive member as claimed in claim 8, wherein said Se-As alloy is a low As content Se-As alloy having an As concentration of about 5% by weight.

10. A photosensitive member as claimed in claim 1, wherein said interference control layer is formed from an Se-Te alloy.

11. A photosensitive member as claimed in claim 10, wherein said Se-Te alloy is an Se-As alloy having a Te concentration of not less than 20% by weight and not more than about 28% by weight.

12. A photosensitive member as claimed in claim 11, wherein said thickness of said interference control layer is not less than 0.04 μm and not more than 0.09 μm.

13. A photosensitive member as claimed in claim 11, wherein said thickness of said interference control layer is not less than 0.17 μm and not more than 0.22 μm.

14. A photosensitive member as claimed in claim 1, wherein said charge transport layer is formed from pure selenium or an Se alloy, said charge generation layer is formed from an Se-Te alloy, said overcoating layer is formed from an Se alloy, and said interference control layer is formed from an Se-Te alloy.

15. A photosensitive member as claimed in claim 14, wherein said charge generation layer is formed from a high Te content Se-Te alloy having a Te concentration of about 43% by weight, said overcoating layer is formed from either a low Te content Se-Te alloy having a Te concentration of about 5% by weight or a low As content Se-As alloy having an As concentration of about 5% by weight, and said interference control layer is formed from an Se-Te alloy having a Te concentration of not less than about 20% by weight and not more than about 28% by weight and the film thickness of said interference control layer is not less than 0.04 μm and not more than 0.09 μm or not less than 0.17 μm and not more than 0.22 μm.

* * * * *